United States Patent [19]

Sloan

[11] 4,352,251

[45] Oct. 5, 1982

[54] HAND OPERATED SUCTION DREDGE HEAD AND HYDRAULIC SUBMERSIBLE PUMP ASSEMBLY

[76] Inventor: Albert H. Sloan, 4200 Kean Rd., Fort Lauderdale, Fla. 33314

[21] Appl. No.: 222,742

[22] Filed: Jan. 5, 1981

[51] Int. Cl.[3] ..... E02F 3/88

[52] U.S. Cl. ..... 37/58; 37/57; 37/72; 285/33

[58] Field of Search ..... 37/58, 59, 61, 62, 63, 37/64, 65, 72, 57, 56, 54; 299/8, 9; 285/33

[56] References Cited

U.S. PATENT DOCUMENTS

| | | | |
|---|---|---|---|
| 371,686 | 10/1887 | Howell | 37/58 |
| 399,251 | 3/1889 | Edwards | 37/58 |
| 528,977 | 11/1894 | Pike | 37/58 |
| 729,479 | 5/1903 | Wittman | 285/33 |
| 1,994,884 | 3/1935 | Chew | 37/57 X |
| 2,028,580 | 1/1936 | Yedd | 37/58 X |
| 2,096,595 | 10/1937 | Sanford | 37/58 |
| 2,125,740 | 8/1938 | Schacht | 37/62 |
| 2,280,066 | 4/1942 | Dorst | 37/58 |
| 2,413,561 | 12/1946 | Hehr | 37/62 |
| 2,605,090 | 7/1952 | Jacobsen | 37/62 |
| 2,774,569 | 12/1956 | Jacobsen | 37/57 |
| 3,429,588 | 2/1969 | Nelson | 37/72 X |
| 3,808,779 | 5/1974 | Randall | 37/62 X |
| 3,910,728 | 10/1975 | Sloan | 417/390 |
| 3,910,837 | 10/1975 | Good | 299/9 X |
| 4,031,973 | 6/1977 | Claye et al. | 299/9 X |
| 4,289,355 | 9/1981 | Rose | 299/9 |

*Primary Examiner*—Clifford D. Crowder

*Attorney, Agent, or Firm*—James E. Nilles

[57] ABSTRACT

A portable and lightweight suction dredge head which is held by a diver and is hand operated so as to be easily moved about in the working position. These heads are, for example of sizes from three inches to eight inches in intake diameter. The dredge head is used for excavating under water and is of the suction type wherein the material is conveyed away from a suction pipe from the dredge head. A jet digger may also be used with the dredge head. A manually operated valve on the dredge head permits the operator to regulate the amount of suction at the inlet of the dredge head and is capable of reducing the amount of suction so as to permit the operator to (1) adjust the density of the material being conveyed, that is regulate the amount of sludge or trash relative to the amount of water that is being conveyed, (2) control the digging aggressiveness of the dredge head, or (3) easily remove foreign material such as rocks, cans or other matter from the inlet of the dredge head or free his hand or foot if it accidently is grabbed by the dredge head. The head is rotatably mounted on the suction pipe which leads to a remote location whereby the head can be easily rotated at the most desirable digging position, and means are provided for insuring that the swivel coupling remains clear of sand or the like and freely operative.

The above dredge head together with a hydraulically driven submersible pump assembly act to eliminate pump priming difficulties and pump sealing problems due to abrasive material, and provides good net positive head, horsepower, speed control, safety and mobility.

27 Claims, 6 Drawing Figures

HAND OPERATED SUCTION DREDGE HEAD AND HYDRAULIC SUBMERSIBLE PUMP ASSEMBLY

BACKGROUND OF THE INVENTION

Various underwater mining devices, dragheads or earth moving suction nozzles have been provided for the purpose of excavating underwater by means of suction, with or without jet diggers, or for mining or in situ disintegration of material below the surface of the water. These devices usually form part of the large apparatus which is moved about as part of large excavating equipment. One example of that type of hydraulic suction nozzle is shown in the U.S. Pat. No. 2,774,569 issued Dec. 18, 1956 and entitled "Earth Moving Hydraulic Suction Nozzles" and wherein the clogging of these nozzles by rocks or other objects is acknowledged as a chief cause of difficulty. In that particular patent, the tubular nozzle has strainer bars and a helical spring at its inlet end in an attempt to remedy that difficulty, however, such an arrangement tends in itself to restrict the in-flow of the material to be removed and becomes clogged itself. Another example of an "Underwater Mining Device" is shown in the U.S. Pat. No. 2,605,090 issued July 29, 1952. That device can be used only for picking up small objects, such as particles of gold or other precious metals underwater and has a very small nozzle area to suction pipe area for that purpose.

A third type of prior art device is shown in U.S. Pat. No. 2,280,066 which issued Apr. 21, 1942 entitled "Draghead For Dredging Apparatus" in which the draghead is used and a central water supply is used to relieve the pressure of the draghead on the surface of the river channel to effect a scouring action.

The above and other prior art devices have had certain shortcomings, among which is the fact that they are incapable of being firmly and positively controlled by the operator who must hold the dredge head in his hands and work for considerable periods of time in a sometimes dark location and under difficult circumstances.

Other type prior art dredging apparatus such as air lifts or hydraulic lifts have not been satisfactory because, among other things, of their lower head capabilities, poor capacity and inability to use them in any position.

SUMMARY OF THE PRESENT INVENTION

The present invention provides a portable, lightweight, hand operated, suction dredge head which the operator can positively, accurately and easily control as to its functions. The dredge head provided by the present invention includes a tubular section nozzle having an inlet end including a gridwork that prevents the entry of foreign material into the nozzle. At the other end of the suction nozzle is located a hand operated valve which adjusts the amount of water admitted into that end of the suction nozzle and consequently adjusts the amount of suction at the inlet of the suction nozzle. The size of these hand operated heads, by way of example, are only from three to eight inches in nozzle diameter. The dredge head further includes a discharge branch extending from the suction nozzle intermediate its length and through which the material from the suction nozzle is discharged into a suction pipe that leads to a rather remote discharge area. A swivel or ball type coupling is provided between the dredge head and the discharge suction pipe which permits rotation or complete swivelling action of the head by the operator. The swivel or ball joint coupling is easily connected and disconnected and means are furthermore provided for using the action of the moving water which is being discharged to flush the coupling clear by this jet pressure and prevent its "freezing" due to accumulation of sand or the like. Optional means may also be provided on the suction nozzle for providing a jet digging action at the area of the nozzle intake to thereby assist in digging and loosening the material to be excavated.

In operation, the present hand dredge nozzle acts to pull itself toward or into the area in which it is digging, that is, the nozzle attempts to "get away" from the operator.

A valve is provided for adjusting the amount of suction at the inlet of the nozzle, and by opening the valve to the desired degree, the suction effect of the nozzle can be reduced thus acting to balance the aggressiveness of the nozzle for better operator control. This valve has spring biasing means to prevent oscillation or "chatter" of the valve. Replaceable bushings are also provided for mounting the valve in the nozzle and for maintaining the valve in an adjusted position without further attention from the operator.

In this manner, the present hand operated dredge has means by which the flow passing through the dredge can be quickly regulated, more specifically, the suction at the inlet of the dredge can be quickly adjusted for good control characteristics, which permits restrictions to be removed from the inlet area, which permits the operator to free his hand or foot which may accidently be engaged by the nozzle, and which furthermore and importantly permits the operator to vary the sledge/-water ratio being conveyed through the dredge, that is, to in effect vary the "density" of the material being removed. This complete and positive control of the dredge is necessary because the operator must often depend only on the sound or vibration of the dredge head to ascertain its characteristics and operating conditions as above mentioned.

A jet digger attachment may also be provided for the above mentioned hand dredge nozzle, which attachment can also be adjusted to help regulate or "balance" the digging aggressiveness of the nozzle by counterbalancing its downward thrust, thereby making the nozzle more easily controlled by the operator. In addition, the jet digger attachment stirs up and agitates the surrounding material, thereby aiding in its excavation.

The present invention also provides a dredging system which includes the above mentioned suction dredge head when used in combination with a hydraulically driven submersible pump assembly and which system eliminates pump priming difficulties and also pump sealing problems due to the abrasive material being handled, and which system furthermore provides good net position suction head, horsepower, speed control, safety and mobility.

These and other objects and advantages of the present invention will appear hereinafter as this disclosure progresses, reference being had to the accompanying drawings.

DESCRIPTION OF A PREFERRED EMBODIMENT

The present invention finds particular utility in working in restricted areas and for rather localized excavation. For example, certain underwater pumping equipment sometimes becomes lost or buried in the floor of the body of water and is difficult, if not impossible to retrieve. An example of this type of equipment are trash pumps TP shown in my U.S. Pat. No. 3,910,728 issued Oct. 7, 1975 and which pumps sometimes dig themselves into and bury themselves in the floor of the lake or ocean. The present invention is utilized to follow the hydraulic lines of such a pump downwardly into the ground and find the pump by excavating the area around it. Furthermore, these dredging operations occur in places where visibility is very poor and the operator must have complete control of the dredge head to be able to manipulate it easily and quickly and positively in any direction. Frequently the inlet of the dredge head becomes clogged with foreign material and due to the suction in the inlet, it is difficult to remove the foreign material or the operator's hand or foot if caught in the nozzle.

Figures 1, 6:
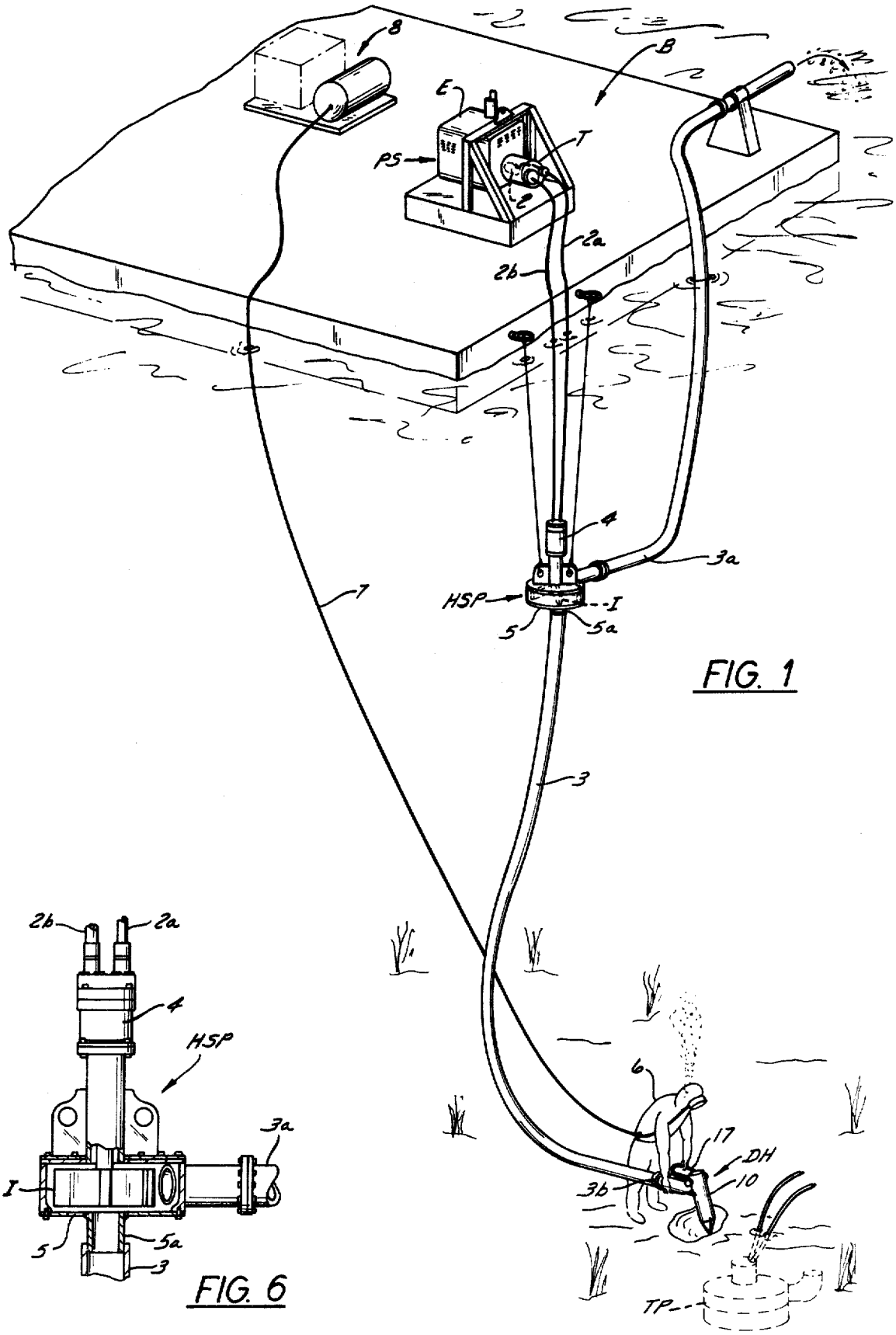
FIG. 1 is a perspective, generally schematic view illustrating the dredge head and pump assembly of the present invention when being utilized to excavate in a restricted underwater location.
FIG. 6 is an enlarged, elevational view, partially in section, of the submersible pump shown in FIG. 1.
Figure 2:
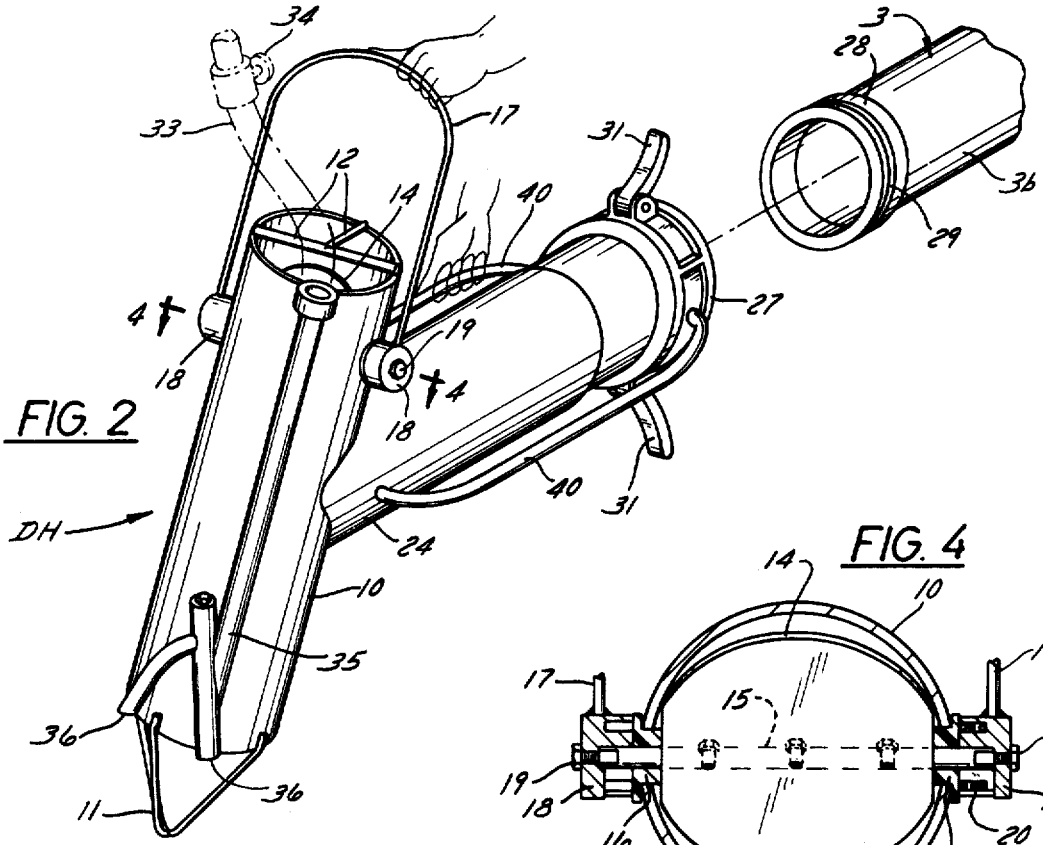
FIG. 2 is a perspective view of the dredge head shown in FIG. 1, but on an enlarged scale.
Figure 4:
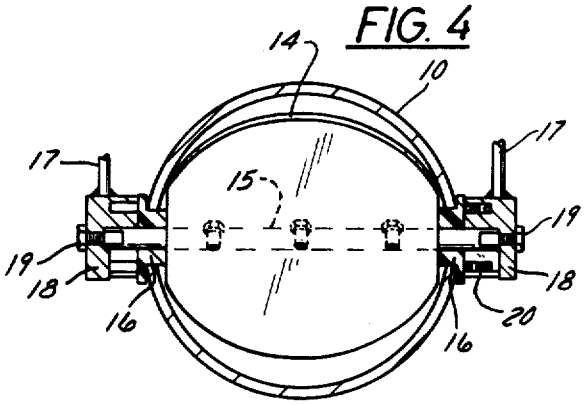
FIG. 4 is a sectional view taken generally along line 4—4 in FIG. 2, but on an enlarged scale and showing the resilient bushings for the valve and the resilient means for preventing chatter thereof.
Figure 3:
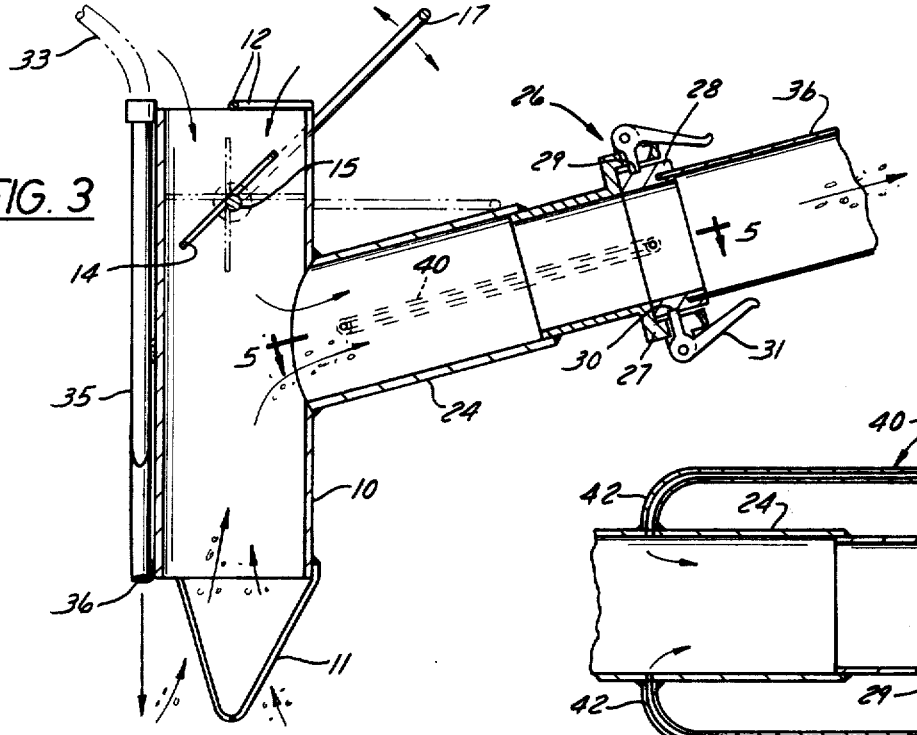
FIG. 3 is a vertical, cross-sectional view through the dredge head shown in FIG. 2.

The present invention can be used in many underwater environments such as shallow ponds, lakes or excavations. As shown in FIG. 1 however, it is shown as used in connection with a vessel on the surface of the water, such as a barge B on which is located the power source PS for operating the hydraulically operated submersible pump HSP located underwater and which in turn is connected to a flexible suction conduit 3. Conduit 3 is connected to the discharge of the dredge head DH. The power source may take the form of the power source PS shown and described in my said U.S. Pat. No. 3,910,728 and which includes an internal combustion engine E that drives a positive displacement pressure fluid pump 2 that directs pressure fluid via flexible conduit 2*a* to a hydraulic motor 4 on the hydraulically operated submersible pump HSP. Flexible conduit 2*b* returns the fluid to the reservoir tank T of the power source PS. The hydraulic motor 4 drives the pump impeller I (FIG. 6) to move water and sludge through conduit 3 and then pump it through discharge conduit 3*a* to a location above the water surface and which is remote from the dredge head DH. The hydraulic submersible pump has a plate 5 secured across its inlet side and a nipple 5*a* extends therefrom for attachment to conduit 3.

Conduit 3 has an inlet end 3*b* which is adapted to be swivelly connected to the dredge head DH to be described. FIG. 1 shows the operator 6 in the working position and who is furnished oxygen for his diving equipment via line 7 from the compressor and oxygen source 8 on the barge. It should be mentioned that an operator utilizing the dredge head of the present invention may often work for hours beneath the surface of the water.

The dredge head DH provided by the present invention is preferably made primarily of an aluminum alloy and is lightweight and easily portable by the operator. Furthermore, the dredge head DH is rather compact and relatively small and has all of its parts within easy reach of the operator. Furthermore, the arrangement and construction of the parts of the dredge head are such that the operator can control the dredge head in the operating position and thereby positively and accurately control its functions and components.

More specifically, the dredge head includes an elongated tubular section nozzle 10 having a lower end to which is welded or otherwise secured a shield or grill 11 fabricated from aluminum alloy rods. This grill prevents relatively large material such as rocks, cans or other foreign material from entering the dredge head. The upper or opposite end of the tubular section nozzle is relatively open except for the rods 12 welded thereacross which prevent inadvertent entry of material therein. Adjacent the upper end of the suction nozzle 10 is a circulate plate, butterfly type valve 14, fixed to and oscillatably mounted on its shaft 15. Shaft 15 is mounted in bushings 16 mounted in the suction nozzle 10. A U-shaped operator's handle 17 is fixed to the shaft 15 by bolts 19 extending through the cup-shaped members 18 that in turn are welded to the handle. Spring 20 is located within one of these cup-shaped members and urges the valve assembly in one direction to prevent oscillation and chatter of the valve when the head is operating. The bushings 16 act to hold the valve in any one of its positions to which it has been adjusted by the operator. The valve is swingable to any one of a number of adjusted positions between a closed position where it prevents water from entering the upper end of the nozzle to a fully open position where water can freely enter the upper end of the nozzle due to the suction in the conduit 3. Bushings may be of brass or resilient material.

The dredge head also includes a tubular discharge branch 24 which is welded to the tubular suction nozzle 10 intermediate the length of the latter and is thereby in fluid communication therewith. It will be noted that the branch 24 extends at an angle to the nozzle 10 which, as indicated in FIG. 1, places the nozzle at a convenient working angle relative to the operator straddled thereover. The rear or discharge end of the branch 24 is secured to the inlet end of the suction conduit 3 by means of a swivel coupling 24 that includes an annular collar 27 formed on the end of the branch 24 and which receives a ring 28 secured on the end 3*b* of the suction conduit 3. The ring 28 has a groove 29 around its periphery in which the inner ends 30 of the clamp 31 are engageable. This groove and clamp connection provides a swivel connection between the dredge head and the suction conduit 3 so the head can be rotated relative to the conduit 3 by the operator to any suitable position.

A jet digger attachment 35 may be provided on the nozzle and has discharge ends 36 through which fluid, such as air or water, under pressure is discharged into the area being dredged to thereby stir up and agitate the material to be pumped and facilitate its excavation. A pressurized water pipe 33 furnishes the pressurized air or water to the jet digger attachment 35 and a valve 34 is provided for operator adjustment of the flow. For instance, this "jet fluid" is provided at a pressure of 90–150 p.s.i. for example, which is required for working with hard mud. On the other hand and if silt is being excavated, the "jet fluid" attachment may not be needed. This jet digger attachment can also be used to regulate the aggressiveness of the nozzle by counterbalancing the downward thrust of the nozzle, also rendering the nozzle easy to control by the operator.

A pair of U-shaped handles 40 are welded to the discharge branch 24 and the operator can conveniently grasp these two handles and firmly hold the dredge head for manipulation to any desired digging position. It should be noted that both the handle 17 and the handles 40 have no free ends around which air, suction or other lines can become entangled and this is important in operations of the type where the present invention finds great utility. The handles 40 afford the operator positive and complete control of positioning and operating the dredge head and provides a good attitude of the working end of the dredge head relative to the operator with complete visibility thereof.

Figure 5:
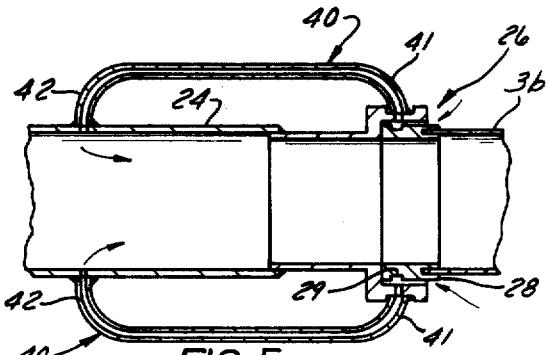
FIG. 5 is a sectional view taken along line 5—5 in FIG. 3 and showing the handle means.

As shown in FIG. 5, the handles 40 are tubular and have their ends 41 and 42 in communication, respectively, with the interior of the swivel joint formed by the swivel coupling and the interior or branch 24. Water which may contain foreign material such as sand, mud, gravel or the like, seeps into the joint from the outside of the dredge head and is thus caused to flow through the handles and then be discharged as shown in the curvilinear arrows into the discharge branch. This jet pressure of the water which is provided by the flow of water through the discharge branch acts to flush the swivel joint and prevent accumulation of sand and the like and keeps the swivel coupling clear of foreign matter to insure free operation of the joint.

OPERATION

If the inlet end of the dredge head becomes obstructed by foreign material such as rocks, cans or other debris or if his hand or foot is accidently engaged by the nozzle, the operator can move the valve 14 simply by swinging the handle 17 to an open or partially open position which immediately reduces the suction at the inlet of the dredge head and thereby permits the operator to remedy the problem. Once the nozzle is unobstructed, the operator can immediately close the valve to reinstate the suction forces at the inlet of the dredge head.

The butterfly valve 14 permits the operator to quickly vary the digging aggressiveness of the nozzle and affords good control thereof.

Even though the operator may be working in a dark location, if the inlet of the dredge head becomes clogged or if too much sludge is being conveyed in comparison to the amount of water being conveyed, he is able to ascertain that by the sound or he can feel it because of the vibration or rumbling of the dredge head and accordingly can vary the density of the sludge/water being conveyed.

The present invention permits the operator to remedy any problems with the dredge head at the source of the problem rather than signalling the barge operator of any trouble. The present dredging apparatus with the dredge head located on the inlet side of the submersed hydraulically driven pump and the pump HSP being located beneath the surface, insures that pump priming problems are avoided.

The present invention provides a particularly efficient dredging system having a hydraulically driven submersible pump acting to provide the suction for the portable hand operated dredge head and which results in relatively low power requirements and eliminates pump priming difficulties in prior art dredging apparatus. Furthermore, the present dredging system is safe in operation, capable of good operator control, eliminates seal failure of the submersible pump due to abrasive material being conveyed, is highly mobile and is highly efficient in providing good positive suction head.

I claim:

1. A portable, lightweight, hand operated dredge head and for being held by the arms of a diver operator for underwater excavating, comprising, a tubular suction nozzle having a lower inlet end and an open upper end for the entry of water therein, a tubular discharge branch extending from said nozzle and at a point intermediate the length of said tubular nozzle, said tubular branch having a discharge end for connection to a suction pipe for conveying excavated material away from said head, swivel coupling means between said discharge end of said branch and said suction pipe whereby said head can be rotationally swivelled relative to said suction pipe and quickly detachably connected thereto, and a hand operated valve pivotally mounted in said nozzle adjacent its upper end, an operator's handle secured to said valve and extending from said nozzle for permitting the diver operator to move said valve to any adjusted position between a closed position and an open position and for thereby varying the amount of water introduced through said valve and into said nozzle to thereby vary the suction at said lower inlet end of said nozzle.

2. The dredge head set forth in claim 1 including handle means on said tubular discharge branch whereby said diver operator can firmly grasp said head and swivel it about said swivel coupling and otherwise manipulate said head, said handle means being tubular and placing said discharge branch in fluid communication with said swivel coupling whereby dirty water is sucked from said swivel coupling and discharged into said discharge branch to thereby keep said coupling free of foreign material.

3. The dredge head set forth in claim 1 further characterized in that said valve is pivotally mounted in said nozzle on bushings in said nozzle, and spring means for preventing chatter of said valve.

4. The dredge head set forth in claim 1 including jet digging means attached to said suction nozzle for discharging pressurized fluid adjacent the lower end of said suction nozzle for agitating material to be drawn into said suction nozzle.

5. A portable, lightweight, hand operated dredge head for underwater excavating, comprising, a tubular suction nozzle having a lower inlet end, a tubular discharge branch extending from said nozzle and having a discharge end for connection to a suction pipe for conveying excavated material away from said head, swivel coupling means between said discharge end of said branch and said suction pipe whereby said head can be rotationally swivelled relative to said suction pipe and quickly detachably connected thereto, handle means on said tubular discharge branch whereby an operator can firmly grasp said head and swivel it about said swivel coupling and otherwise manipulate said head, said handle means being tubular and placing said discharge branch in fluid communication with the interior of said swivel coupling whereby dirty water is sucked from said swivel coupling and discharged into said discharge branch to thereby keep said coupling free of foreign material, and a hand operated valve pivotally mounted in resilient bushings in said nozzle, spring means biasing said valve for preventing chatter of said valve, an operator's handle secured to said valve and extending from said nozzle for moving said valve to any adjusted position between a closed position and an open position and for thereby varying the amount of water introduced through said valve and into said nozzle to thereby vary the suction at said lower inlet end of said nozzle and regulating and digging aggressiveness of the dredge head.

6. A portable, lightweight, hand operated dredge head for being held in the arms of a diver operator for underwater excavating, comprising, a rigid tubular suction nozzle having a lower inlet end and an open upper end for the entry of water therein, means on the lower inlet end of said nozzle for restricting movement of trash into said nozzle, a tubular discharge branch extending from said nozzle intermediate its length and in fluid communication therewith and having a discharge end for connection to a suction pipe for conveying excavated material away from said head, swivel coupling means between said discharge end of said branch and said suction pipe whereby said head can be rotationally swivelled relative to said suction pipe and quickly detachably connected thereto, a hand operated valve pivotally mounted in said nozzle adjacent its said upper end, an operator's handle fixed with said valve and extending from said nozzle and for permitting said diver operator to move said valve to any adjusted position between a closed position and an open position and for varying the amount of water introduced through said upper end into said nozzle to thereby vary the suction at said lower inlet end of said nozzle to permit removal of trash from said trash restriction means and regulate the digging aggressiveness of the dredge head.

7. The dredge head set forth in claim 6 including handle means on said tubular discharge branch whereby said operator can firmly grasp said head and swivel it about said swivel coupling and otherwise manipulate said head, said handle means being tubular and placing said discharge branch in fluid communication with said swivel coupling whereby dirty fluid is flushed from said swivel coupling and discharged into said discharge branch to thereby prevent accumulation of sand and the like in said coupling.

8. The dredge head set forth in claim 6 further characterized in that said valve is pivotally mounted in said nozzle by means of bushings fixed in said nozzles, and resilient means for preventing said valve from chattering.

9. The dredge head set forth in claim 6 including jet digging means attached to said suction nozzle for discharging pressurized fluid adjacent the lower end of said suction nozzle for agitating or loosening material to be drawn into said suction nozzle and for counterbalancing the digging action of said dredge head.

10. A portable, lightweight, hand operated dredge head for underwater excavating, comprising, a tubular suction nozzle having a lower inlet end and an upper end, means on the lower inlet end of said nozzle for restricting movement of trash into said nozzle, a tubular discharge branch extending from said nozzle intermediate its length and in fluid communication therewith and having a discharge end for connection to a suction pipe for conveying excavated material away from said head, swivel coupling means between said discharge end of said branch and said suction pipe whereby said head can be rotationally swivelled relative to said suction pipe and quickly detachably connected thereto, handle means on said tubular discharge branch whereby an operator can firmly grasp said head and swivel it about said swivel coupling and otherwise manipulate said head, said handle means being tubular and placing said discharge branch in fluid communication with said swivel coupling whereby dirty fluid is flushed from said swivel coupling and discharged into said discharge branch to thereby prevent accumulation of sand and the like in said coupling, a hand operated valve pivotally mounted in bushings in said nozzle adjacent its said upper end, resilient means biasing said valve for preventing said valve from chattering, an operator's handle fixed with said valve and extending from said nozzle and for moving said valve to any adjusted position between a closed position and an open position and for varying the amount of water introduced through said upper end into said nozzle to thereby (1) vary the suction at said lower inlet end of said nozzle and permit removal of trash from said trash restriction means, (2) regulate the digging action of said dredge head and (3) vary the sludge/water ratio being discharged from said dredge head.

11. A dredging system including, a power source, a pressure fluid pump connected to and driven by said power source, a source of fluid for said fluid pump, a hydraulically driven submerged pump including a housing having a suction inlet and having a discharged outlet, a suction conduit extending from said suction inlet, an impeller rotatably mounted in said housing, a fluid motor connected to said impeller for rotatably driving said impeller, a pair of fluid conduits connected between said fluid pump and said motor whereby said fluid pump delivers pressure fluid to said motor for driving said impeller and returns fluid to said source of fluid, a hand operated dredge head for underwater use and comprising a tubular suction nozzle having a lower inlet end, said nozzle having a discharge end connected to said suction conduit, and a hand operated valve pivotally mounted in said head for moving to any adjusted position between a closed position and an open position and for thereby varying the amount of water introduced through said valve to thereby vary the suction at said lower inlet end of said nozzle, whereby said impeller of said submerged pump causes excavated material to be conveyed from said dredge head and delivered to a location remote from said dredge head.

12. The system set forth in claim 11 further characterized in that said power source, pressure fluid pump and source of fluid for said fluid pump are located out of the water and said pair of fluid conduits extend underwater to said submerged hydraulically driven pump.

13. The system set forth in claim 11 further characterized in that said power source, pressure fluid pump and source of fluid for said fluid pump are located out of the water and said pair of fluid conduits extend underwater to said submerged hydraulically driven pump.

14. The system set forth in claim 11 including handle means on said tubular discharge branch whereby an operator can firmly grasp said head and swivel it about said swivel coupling and otherwise manipulate said head, said handle means being tubular and placing said discharge branch in fluid communication with said swivel coupling whereby dirty water is flushed from said swivel coupling and discharged into said discharge branch to thereby keep said coupling free of foreign material.

15. A dredging system including, a power source, a pressure fluid pump connected to and driven by said power source, a source of fluid for said fluid pump, a hydraulically driven submerged pump including a housing having a suction inlet and having a discharge outlet, a suction conduit extending from said suction inlet, an impeller rotatably mounted in said housing, a fluid motor connected to said impeller for rotatably driving said impeller, a pair of fluid conduits connected between said fluid pump and said motor whereby said fluid pump delivers pressure fluid to said motor for driving said impeller and returns fluid to said source of fluid, a portable hand operated dredge head for underwater use and comprising a tubular suction nozzle having a lower inlet end, a tubular discharge branch extending from said nozzle and having a discharge end for connection to said suction conduit, swivel coupling means between said discharge end of said branch and said suction conduit whereby said head can be rotationally swivelled relative to said suction conduit and quickly detachably connected thereto, and a hand operated valve pivotally mounted in said nozzle, an operator's handle secured to said valve and extending from said nozzle for moving said valve to any adjusted position between a closed position and an open position and for thereby varying the amount of water introduced through said valve and into said nozzle to thereby vary the suction at said lower inlet end of said nozzle, whereby said impeller of said submerged pump conveys excavated material from said dredge head and delivers it to a location remote from said dredge head, said submerged hydraulic pump requiring no pump priming.

16. A dredging system including, an internal combustion engine, a hydraulic circuit, a pressure fluid pump in said circuit and connected to and driven by said engine, a source of fluid in said circuit for said fluid pump, a hydraulically driven submerged pump including a housing having a suction inlet and having a discharge outlet, a suction conduit extending from said suction inlet, an impeller rotatably mounted in said housing, a fluid motor connected to said impeller for rotatably driving said impeller, a pair of fluid conduits in said circuit and connected between said fluid pump and said fluid motor whereby said fluid pump delivers pressure fluid to said motor for driving said impeller and returns fluid to said source of fluid, a hand operated dredge head for underwater use and comprising a tubular suction nozzle having a lower inlet end, said nozzle having a discharge end connected to said suction conduit, coupling means between said discharge end of said nozzle and said suction conduit, and a hand operated valve pivotally mounted in said head for moving to any adjusted position between a closed position and an open position and for thereby varying the amount of water introduced through said valve to thereby vary the suction at said lower inlet end of said nozzle, whereby said impeller of said submerged pump causes excavated material to be conveyed from said dredge head and deliver it to a location remote from said dredge head.

17. The system set forth in claim 16 including a vessel on the surface of the water in which said pump is submerged, further characterized in that said power source, pressure fluid pump and source of fluid for said fluid pump are located on said vessel, and said pair of fluid conduits extend underwater to said submerged hydraulically driven pump.

18. A portable, lightweight, hand operated dredge head for underwater excavating, comprising, a tubular suction nozzle having a lower inlet end, a tubular discharge branch extending from said nozzle and having a discharge end for connection to a suction pipe for conveying excavated material away from said head, coupling means between said discharge end of said branch and said suction pipe whereby said head can be moved relative to said suction pipe and quickly detachably connected thereto, and a hand operated valve pivotally mounted in said nozzle, an operator's handle secured to said valve and extending from said nozzle for moving said valve to any adjusted position between a closed position and an open position and for thereby varying the amount of water introduced through said valve and into said nozzle to thereby vary the suction at said lower inlet end of said nozzle, and handle means on said tubular discharge branch whereby an operator can firmly grasp said head and move it about said coupling and otherwise manipulate said head, said handle means being tubular and placing the interior of said head in fluid communication with said coupling whereby dirty water is purged from said coupling to thereby keep said coupling free of foreign material.

19. A portable, lightweight, hand operated dredge head for underwater excavating, comprising, a tubular suction nozzle having a lower inlet end and an upper end, means on the lower inlet end of said nozzle for restricting movement of trash into said nozzle, a tubular discharge branch extending from said nozzle intermediate its length and in fluid communication therewith and having a discharge end for connection to a suction pipe for conveying excavated material away from said head, coupling means between said discharge end of said branch and said suction pipe whereby said head can be moved relative to said suction pipe and quickly detachably connected thereto, a hand operated valve pivotally mounted in said nozzle adjacent its said upper end, an operator's handle fixed with said valve to any adjusted position between a closed position and an open position and for varying the amount of water introduced through said upper end into said nozzle to thereby vary the suction at said lower inlet end of said nozzle to permit removal of trash from said trash restriction means and regulate the digging aggressiveness of the dredge head, and handle means on said tubular discharge branch whereby an operator can firmly grasp said head and move it about said coupling and otherwise manipulate said head, said handle means being tubular and placing the interior of said head in fluid communication with said coupling whereby dirty fluid is flushed from said coupling to thereby prevent accumulation of sand and the like in said coupling.

20. The dredge head set forth in claim 1 or 5 or 6 or 10 or 18 or 19, further characterized in that said hand operated valve is a circular plate, butterfly type valve pivotally mounted in and adjacent the upper end of said nozzle.

21. The dredge head set forth in claim 1 or 5 or 6 or 10 or 18 or 19, further characterized in that said head is quickly detachably connected to said suction pipe by a swivel coupling including a collar, a ring receivable in said collar and having an annular groove therein, and a swingable clamp releasably engageable in said groove.

22. A dredging system including, a power source, a pressure fluid pump connected to and driven by said power source, a source of fluid for said fluid pump, a hydraulically driven submerged pump including a housing having a suction inlet and having a discharge outlet, a suction conduit extending from said suction inlet, an impeller rotatably mounted in said housing, a fluid motor connected to said impeller for rotatably driving said impeller, a pair of fluid conduits connected between said fluid pump and said motor whereby said fluid pump delivers pressure fluid to said motor for driving said impeller and returns fluid to said source of fluid, a hand-operated dredge head for underwater use and comprising a tubular suction nozzle having a lower inlet end, said nozzle having a discharge end connected to said suction conduit, and a hand operated valve pivotally mounted in said head for moving to any adjusted position between a closed position and an open position and for thereby varying the amount of water introduced through said valve to thereby vary the suction at said lower inlet end of said nozzle, whereby said impeller of said submerged pump causes excavated material to be conveyed from said dredge head and delivered to a location remote from said dredge head, handle means on said tubular discharge branch whereby an operator can firmly grasp said head and swivel it about said swivel coupling and otherwise manipulate said head, said handle means being tubular and placing the interior of said head in fluid communication with said coupling whereby dirty water is flushed from said coupling to thereby keep said coupling free of foreign material.

23. The system of claim 11 or 15 or 16 or 22, further characterized in that said hand operated valve is a circular plate, butterfly type valve pivotally mounted in and adjacent the upper end of said nozzle.

24. The system of claim 15 or 16 or 22, further characterized in that said head is quickly detachably connected to said suction pipe by a swivel coupling including a collar, a ring receivable in said collar and having an annular groove therein, and a swingable clamp releasably engageable in said groove.

25. A portable, lightweight, hand operated dredge head for being held by the arms of a diver operator for underwater excavating, comprising a rigid tubular section nozzle having a lower inlet end and an open upper end for the entry of water therein, a rigid tubular discharge branch secured to and extending from said nozzle and at a point intermediate the length of said tubular nozzle, said rigid tubular branch having a discharge end for connection to a suction pipe for conveying excavated material away from said head, and a hand operated valve pivotally mounted in said nozzle adjacent its upper end, an operator's handle secured to said valve and extending from said nozzle for permitting the diver operator to move said valve to any adjusted position between a closed position and an open position and for thereby varying the amount of water introduced through said valve and into said nozzle to thereby vary the suction at said lower inlet end of said nozzle.

26. The dredge head set forth in claim 25 further characterized in that said hand operated valve is a butterfly valve extending across said upper end of said tubular suction nozzle, and said operator's handle is of U-shape.

27. The dredge head set forth in claim 26 including a jet digger attachment secured along said nozzle and having a discharge end adjacent said lower inlet end of said tubular suction nozzle.

* * * * *